United States Patent [19]

Goffe et al.

[11] Patent Number: 4,875,081

[45] Date of Patent: Oct. 17, 1989

[54] ELECTROPHOTOGRAPHIC DEVICE HAVING A.C. BIASED CLEANING MEMBER

[75] Inventors: William L. Goffe, Webster; Joseph G. Schram, Liverpool, both of N.Y.

[73] Assignee: Xerox Corporation, Stamford, Conn.

[21] Appl. No.: 261,869

[22] Filed: Oct. 24, 1988

[51] Int. Cl.[4] ..... G03G 15/08; G03G 15/00

[52] U.S. Cl. ..... 355/303; 355/297; 355/298; 355/299; 355/300; 355/305

[58] Field of Search ..... 355/303, 297, 298, 299, 355/300, 305

[56] References Cited

U.S. PATENT DOCUMENTS

| | | | |
|---|---|---|---|
| 3,572,923 | 3/1971 | Fisher et al. | 355/15 |
| 3,668,008 | 6/1972 | Severynse | 134/1 |
| 3,728,016 | 4/1973 | Harbour, Jr. et al. | 355/303 X |
| 3,848,993 | 11/1974 | Hasiotis | 355/15 |
| 3,917,397 | 11/1975 | Tanaka et al. | 355/303 X |
| 3,942,889 | 3/1976 | Kurita et al. | 355/303 |
| 4,123,154 | 10/1978 | Fisher | 355/303 |
| 4,154,522 | 5/1979 | Ikesue | 355/15 |
| 4,185,910 | 1/1980 | Nomura et al. | 355/303 X |
| 4,286,039 | 8/1981 | Landa et al. | 430/119 |
| 4,423,950 | 1/1984 | Sagami | 355/303 X |
| 4,469,435 | 9/1984 | Nosaki et al. | 355/303 |
| 4,481,275 | 11/1984 | Iseki et al. | 430/125 |
| 4,627,717 | 12/1986 | Thompson et al. | 355/15 |
| 4,647,179 | 3/1987 | Schmidlin | 355/3 DD |
| 4,705,387 | 11/1987 | Lin | 355/303 |

*Primary Examiner*—A. C. Prescott

*Attorney, Agent, or Firm*—Mark Costello

[57] ABSTRACT

In a cleaning arrangement for the removal of residual toner from a charge retentive surface, such as a photoreceptor surface in a reproduction machine, after a transfer step, a conductive cleaning member is arranged closely adjacent the surface. An A.C. voltage is applied to the member. In such an arrangement, toner in the vicinity of the blade is observed to jump from the surface in response to the electric field created at the member, forming an oscillating toner cloud. The agitated toner further aids in removal of toner from the surface by causing a large number of toner/toner impacts that jar toner held on the surface into movement. Toner held on the surface is thus removed electrostatically and mechanically. Toner in the cloud configuration may be easily removed from the area adjacent the surface by an airstream through the area, a biased collecting surface, or a traveling electrostatic wave arrangement, among other methods.

29 Claims, 3 Drawing Sheets

ELECTROPHOTOGRAPHIC DEVICE HAVING A.C. BIASED CLEANING MEMBER

Figure 1:
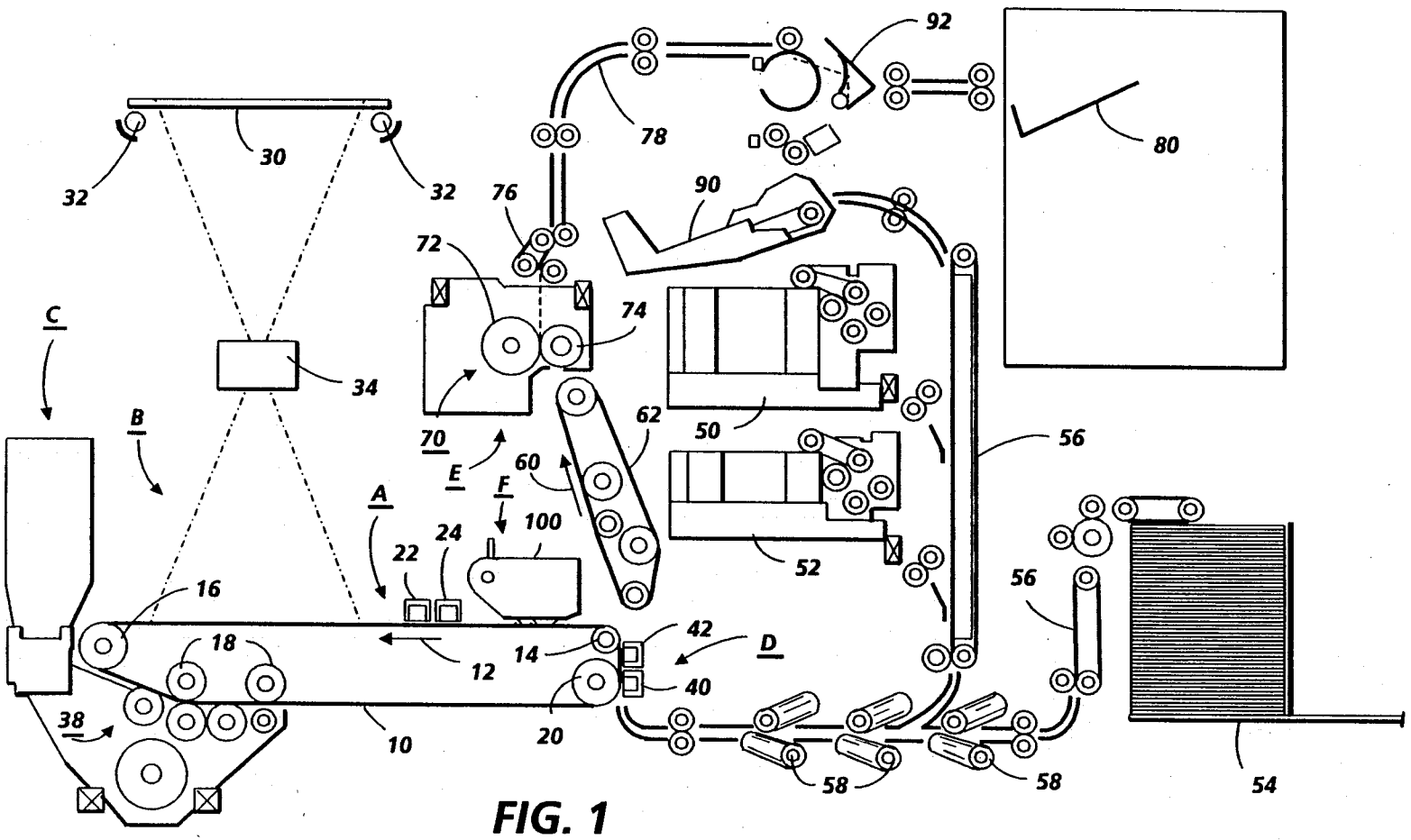

The present invention relates generally to the cleaning of toner from a charge retentive surface in an electrophotographic device, and more particularly, to a non-frictional cleaning method.

INCORPORATION BY REFERENCE

The following are incorporated herein by reference for their teachings: U.S.-A 4,647,179 to Schmidlin, U.S.-A 4,154,522 to Ikesue, U.S.-A 4,286,039 to Landa et al., U.S.-A 3,728,016 to Harbour, Jr. et al., U.S.-A 4,481,275 to Iseki et al., U.S.-A 3,668,008 to Severynse, U.S.-A 4,627,717 to Thompson et al., U.S. patent application Ser. No. 200,328, filed May 31, 1988 to Hays, and U.S.-A 3,572,923 to Fisher et al.

BACKGROUND OF THE INVENTION

In electrophotographic applications such as xerography, a charge retentive surface is electrostatically charged, and exposed to a light pattern of an original image to be reproduced, to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "tones". Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. The process is well known, and is useful for light lens copying from an original, and printing applications from electronically generated or stored originals, where a charged surface may be discharged in a variety of ways. Ion projection devices where a charge is imagewise deposited on a charge retentive substrate operate similarly.

Although a preponderance of the toner forming the image is transferred to the paper during transfer, some toner invariably remains on the charge retentive surface, it being held thereto by relatively high electrostatic and/or mechanical forces. Additionally, paper fibers, Kaolin and other debris have a tendency to be attracted to the charge retentive surface. It is essential for optimum imaging that the toner and debris remaining on the surface be cleaned thoroughly therefrom.

Blade cleaning is highly desirable method for removal of residual toner and debris (hereinafter, collectively referred to as "toner") from a charge retentive surface. In a typical application, a relatively thin elastomeric blade member is provided and supported adjacent and transversely across the charge retentive surface with a blade edge chiseling or wiping toner from the surface. Subsequent to release of toner from the surface, the released toner accumulating adjacent the blade is transported away from the blade area by a toner transport arrangement or gravity. Unfortunately, blade cleaning suffers from certain deficiencies, primarily resulting from the frictional sealing contact which must be maintained between the blade and the charge retentive surface. Friction between the surfaces causes wearing away of the blade edge, and damaging wearing contact with the charge retentive surface. In addition to the problem of wear, which is more or less predictable over time, blades are also subject to unpredictable failures. The blade may flatten toner and cause impaction of toner on the surface. The impact from carrier beads remaining on the charge retentive surface subsequent to development may damage the blade, and sudden localized increases in friction between the blade and surface may cause the phenomenon of tucking, where the blade lead edge becomes tucked underneath the blade, losing the frictional sealing relationship required for blade cleaning. These problems require removal and replacement of the blade. Filming on the charge retentive surface may occur even though toner is cleaned from the surface. Filming, which can be a gradual buildup of material on the charge retentive surface can deteriorate image quality. Filming occurs either uniformly or streaking, due to deficiencies in blade cleaning, requiring the use of a lubricant and a balancing abrasion element to prevent filming. A large number of lubricant schemes have been tried to reduce friction to increase life of the blade, reduce wear on the photoreceptor, prevent tucking and minimize toner impaction, including and not limited to various dusting arrangements with dry lubricants, toner additives, coatings and fillings for the blade, etc. While it might appear that a rigid metal blade might solve the problems of rigidity and wear, in fact, the frictional contact required between the surface and blade quickly wears away the blade and any surface lubricants applied thereto. Even when blade cleaning works well, a problem still exists in removing the pile of toner from the charge retentive surface in front of the blade. A large number of toner removal schemes have been proposed, such as vacuum or other air flow arrangements, biased rolls and brushes, augers or electrostatic transports as well as numerous others. All have problems in removing toner from the area adjacent the blade. Of course, blade cleaning also presents numerous other problems, including controlling the accuracy of the alignment of the blade with the charge retentive surface, controlling uniformity of force along the blade edge contacting the charge retentive surface, and design restrictions in desirable orientations and locations along the charge retentive surface for easy removal of toner collecting at the blade.

It is known that a biased member attracts and repels toner, as shown by U.S.-A 4,154,522, to Ikesue, where an electrode on the charge retentive surface attracts toner cleaned from the charge retentive surface to be carried to the development station, U.S.-A 4,286,039 to Landa et al., where a roller is biased to pick up toner, and U.S.-A 3,728,016 to Harbour, Jr. et al. which shows a porous elastomeric wiper which is periodically biased to repel toner adhering thereto. U.S.-A 3,848,993 to Hasiotis suggests an applied voltage to a metal member supporting an elastomeric member in contact with a charge retentive surface to either attract or repel toner at the cleaning edge. U.S.-A 4,481,275 Iseki et al shows that the charge retentive surface may be charged and used to collect toner. Of course, a biased brush member is often used in brush cleaning, where biased fibers in a brush collect toner, and differently biased detoning rolls are used to remove the toner from the brush fibers. U.S. patent application Ser. No. 200,328, filed May 31, 1988, and assigned to the same assignee as the present application, suggests that development of a latent image on a surface might be accomplished from a biased donor roll with an A.C. biased electrode interposed between the donor roll and the latent image-bearing substrate, with the effect of detachment of toner from the surface to create a cloud of toner available for development.

U.S.-A 3,668,008 to Severynse teaches the use of an ionized air flow for the neutralization of charge and removal of toner from a charge retentive surface.

A preclean corotron is sometimes used to neutralize charge on the charge retentive surface prior to removal of toner therefrom, as shown, for example, in U.S.-A 3,572,923 to Fisher et al. which shows a D.C. corotron, although A.C. corotrons have also been used. Image disturbers, to disturb or puddle toner prior to cleaning to make detachment of toner by the cleaner easier, and are characterized by either mechanical devices, which brush against the toner or other arrangements, such as for example, U.S.-A 4,627,717 to Thompson et al., which provides a magnetic field closely adjacent to the charge retentive surface. The use of multiple colors of toner makes cleaning even more difficult, because of the different charge characteristics of the different types of toner, which sometimes requires charge neutralization to deal with the charged state after cleaning.

SUMMARY OF THE INVENTION

In accordance with the invention, there is provided an improved cleaning device for reduction friction removal of toner from a charge retentive surface or photoreceptor surface.

In a cleaning arrangement for the removal of residual toner from a charge retentive surface, such as a photoreceptor surface in a reproduction machine, after a transfer step, a conductive cleaning member is arranged transversely across and closely adjacent the surface. An A.C. voltage of a selected voltage f is applied to the member to produce an A.C. field at the edge of the blade adjacent the photoreceptor. In such an arrangement, toner in the vicinity of the member is observed to jump from the surface in response to the electric field created at the member, forming an oscillating toner cloud. The agitated toner further aids in removal of toner from the surface by causing a large number of toner/toner impacts that jar toner held on the surface into movement. Toner held on the surface is thus removed electrostatically and mechanically. Toner in the cloud configuration may be easily removed from the cleaning member vicinity in a variety of ways.

In accordance with another aspect of the invention, the cleaning member may be a blade supported in low force contact with the charge retentive surface to reduce the wearing friction between the blade and the charge retentive surface. The importance of alignment of the blade with respect to the charge retentive surface is reduced in criticality.

In accordance with still another aspect of the invention, the cleaning member may be a thin wire electrode supported in low force contact with the charge retentive surface. The wire is allowed some degree of flex to allow it to ride on the photoreceptor.

In accordance with yet another aspect of the invention, airborne toner released from the charge retentive surface by the A.C. biased cleaning member may be conveniently removed from the area adjacent thereto with a directed airflow, including a vacuum device or a combination of a blower and vacuum.

In accordance with another aspect of the invention, airborne toner may be collected on a charged surface and subsequently removed therefrom as the surface is moved to another location, including motion in or against the process direction or at 90° to the process direction.

In accordance with another aspect of the invention, airborne toner may be collected on a surface and moved with a changing electrostatic field, such as a traveling electrostatic wave conveyor disclosed, for example, in U.S.-A 4,647,179 to Schmidlin.

The inventive A.C. biased member cleaning arrangement advantageously provides long life with a low force surface contact. Toner lubricant is not required, because the low friction contact prevents excessive wear and because no blade induced toner impaction is expected. Clouded toner is easily collected and removed from the vicinity of the member. In addition to these advantages, the arrangement provides an easily controllable cleaning device, where cleaning may be stopped and started by control of applied voltage. The arrangement allows the possibility of many uses of the arrangement other than traditional cleaning functions.

Figure 2:
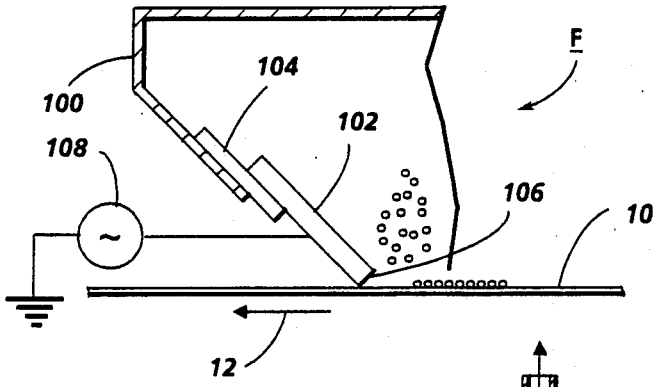
Figure 3:
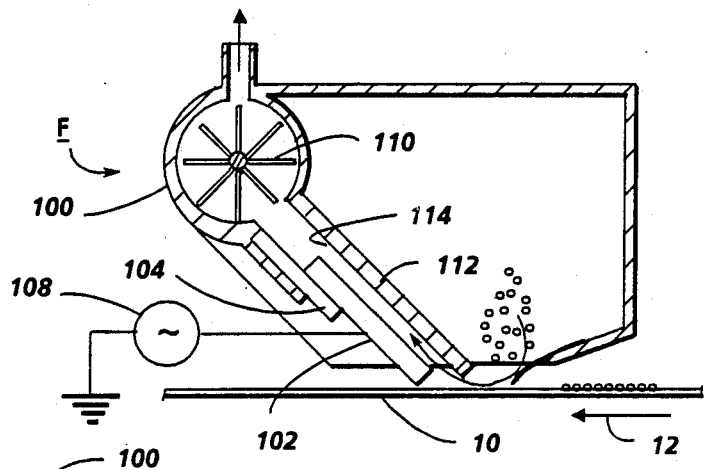
Figure 4:
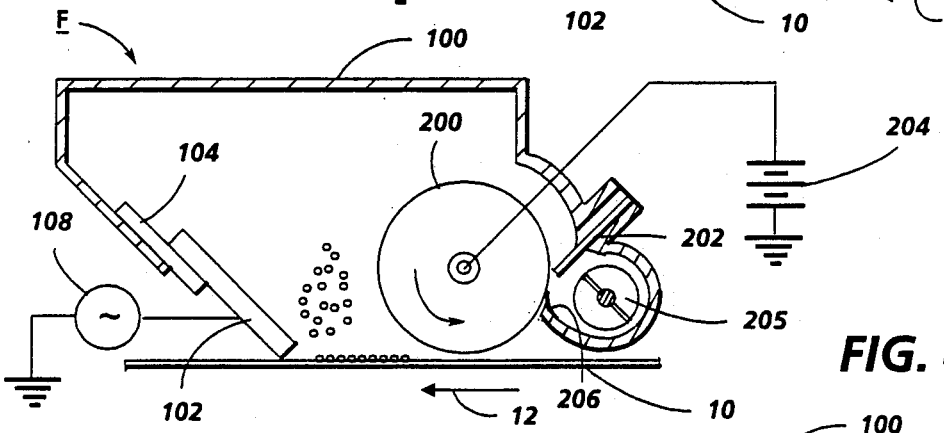
Figure 4A:
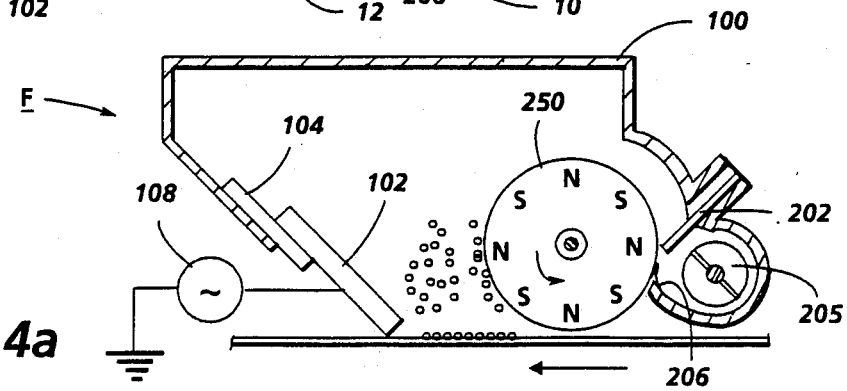
Figure 5:
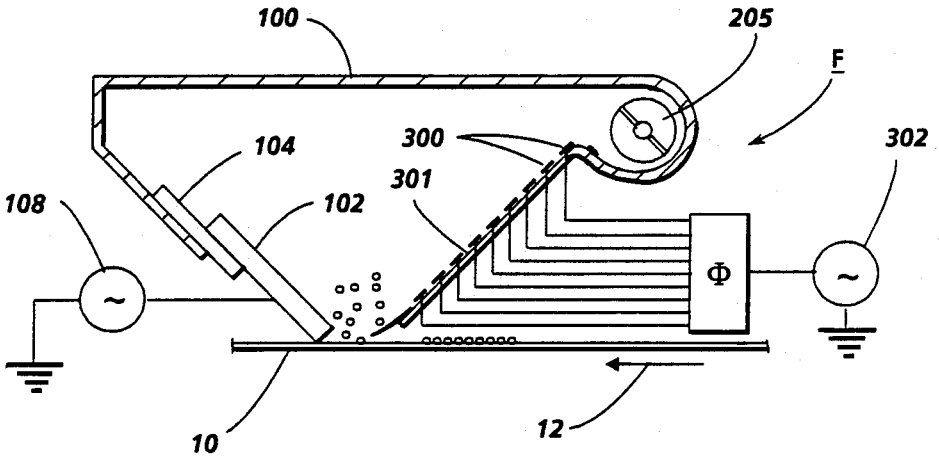
Figure 6:
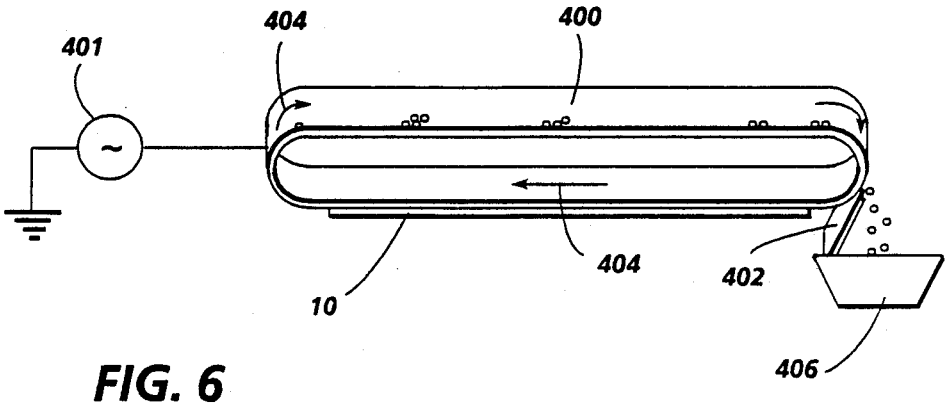
Figure 7:
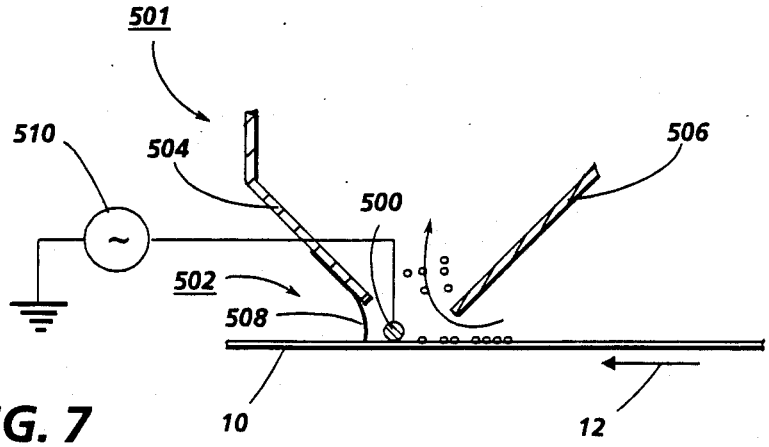

These and other aspects of the invention will become apparent from the following description used to illustrate a preferred embodiment of the invention read in conjunction with the accompanying drawings in which:

FIG. 1 is a schematic elevational view depicting an electrophotographic printing machine incorporating the present invention;

FIG. 2 schematically illustrates a blade cleaner in accordance with the present invention incorporated in the machine of FIG. 1;

FIG. 3 schematically illustrates a blade cleaner in accordance with the present invention, with an airflow toner removal arrangement;

FIG. 4 schematically illustrates a blade cleaner in accordance with the present invention, with a biased member toner removal arrangement;

FIG. 4A schematically illustrates a blade cleaner in accordance with the present invention, with a magnetic member toner removal arrangement;

FIG. 5 schematically illustrates a blade cleaner in accordance with the present invention, with a changing electrostatic field, such as a traveling electrostatic wave conveyor for toner removal;

FIG. 6 schematically illustrates a blade cleaner in accordance with the present invention wherein the blade forms a continuous loop member, and is moved along a continuous path defined by the loop to collect and transport toner away from the charge retentive surface; and FIG. 7 illustrates a cleaner with a thin wire providing the electric field causing toner clouding.

Referring now to the drawings, where the showings are for the purpose of describing a preferred embodiment of the invention and not for limiting same, the various processing stations employed in the reproduction machine illustrated in FIG. 1 will be described only briefly. It will no doubt be appreciated that the various processing elements also find advantageous use in electrophotographic printing applications from an electronically stored original. Accordingly, a reproduction machine in which the present invention finds advantageous use utilizes a photoreceptor belt 10. Belt 10 moves in the direction of arrow 12 to advance successive portions of the belt sequentially through the various processing stations disposed about the path of movement thereof.

Belt 10 is entrained about stripping roller 14, tension roller 16, idler rollers 18, and drive roller 20. Drive roller 20 is coupled to a motor (not shown) by suitable means such as a belt drive.

Belt 10 is maintained in tension by a pair of springs (not shown) resiliently urging tension roller 16 against belt 10 with the desired spring force. Both stripping roller 14 and tension roller 16 are rotatably mounted. These rollers are also idlers which rotate freely as belt 10 moves in the direction of arrow 16.

With continued reference to FIG. 1, initially a portion of belt 10 passes through charging station A. At charging station A, a pair of corona devices 22 and 24 charge photoreceptor belt 10 to a relatively high, substantially uniform negative potential.

At exposure station B, an original document is positioned face down on a transparent platen 30 for illumination with flash lamps 32. Light rays reflected from the original document are reflected through a lens 34 and projected onto a charged portion of photoreceptor belt 10 to selectively dissipate the charge thereon. This records an electrostatic latent image on the belt which corresponds to the informational area contained within the original document.

Thereafter, belt 10 advances the electrostatic latent image to development station C. At development station C, a magnetic brush developer unit 38 advances a developer mix (i.e. toner and carrier granules) into contact with the electrostatic latent image. The latent image attracts the toner particles from the carrier granules thereby forming toner powder images on photoreceptor belt 10.

Belt 10 then advances the development latent image to transfer station D. At transfer station D, a sheet of support material such as a paper copy sheet is moved into contact with the developed latent images on belt 10. First, the latent image on belt 10 is exposed to a pretransfer light from a lamp (not shown) to reduce the attraction between photoreceptor belt 10 and the toner powder image thereon. Next corona generating device 40 charges the copy sheet to the proper potential so that it is tacked to photoreceptor belt 10 and the toner powder image is attracted from photoreceptor belt 10 to the sheet. After transfer, a corona generator 42 charges the copy sheet to an opposite polarity to detack the copy sheet for belt 10, whereupon the sheet is stripped from belt 10 at stripping roller 14.

Sheets of support material are advanced to transfer station D from supply trays 50, 52 and 54, which may hold different quantities, sizes and types of support materials. Sheets are advanced to transfer station D along conveyor 56 and rollers 58. After transfer, the sheet continues to move in the direction of arrow 60 onto a conveyor 62 which advances the sheet to fusing station E.

Fusing station E includes a fuser assembly, indicated generally by the reference numeral 70, which permanently affixes the transferred toner powder images to the sheets. Preferably, fuser assembly 70 includes a heated fuser roller 72 adapted to be pressure engaged with a back-up roller 74 with the toner powder images containing fuser roller 72. In this manner, the toner powder image is permanently affixed to the sheet.

After fusing, copy sheets bearing fused images are directed through decurler 76. Chute 78 guides the advancing sheet from decurler 76 to catch tray or a finishing station 80 for binding, stampling, collating etc. and removal from the machine by the operator. Alternatively, the sheet may be advanced to a duplex tray 90 from duplex gate 92 from which it will be returned to the processor and conveyor 56 for receiving second side copy.

Residual toner remaining on the photoreceptor belt 10 after transfer will be removed from the belt at a cleaning station F which includes cleaning housing 100 to support the inventive cleaning arrangement described below.

As thus described, a reproduction machine in accordance with the present invention may be any of several well known devices. Variation may be expected in specific processing, paper handling and control arrangements without affecting the present invention.

In accordance with one embodiment of the invention, and with reference to FIGS. 1 and 2, cleaning station F is generally comprised of a cleaning housing 100, within which an A.C. biased cleaning member is supported for removal of residual toner from a charge retention surface. In a first embodiment, cleaning blade 102 is supported on a somewhat flexible support member 104 transversely across, and with blade edge 106 in light contact with photoreceptor belt 10. Cleaning blade 102 may be a conductive metal member of a material suitable for withstanding long periods of corona production. Steel, tungsten and beryllium copper are examples of suitable known coronode materials, that would be also useful for the present invention, because of resistance to corrosion by corona and its byproducts, machinability to a desired shape. A glass blade with a suitable coronode material supported thereon or therein may also be possible. A variety of cross-sectional edge shapes of the blade are possible, keeping in mind that corona is best produced at an edge. A sharpened edge may be desirable, as may be the removal of other edges where corona might be produced. Blade 102 is supported on a flexible member 104 that will assist in maintaining conformance of the blade edge to the belt 10, which in the case of an AMAT belt, has a tendency to flex. Flexible member 104 may not be required in the case of a rigid selenium drum. While it is preferred that the blade be supported in light contact with photoreceptor belt 10, in order to maintain the electric field created at the blade edge 106 at a constant level, the cleaning action of the inventive arrangement occurs about 1 millimeter ahead of the blade, and thereby allows the possibility of a slight spacing between the blade 102 and belt 10. The greatest desirable spacing between the blade and the surface is believed to correspond to the area in which corona is produced.

In operation, the A.C. biased blade operation depends upon applied voltage, applied frequency and relative speed between the photoreceptor surface and the blade. Blade 102 is biased with a high voltage A.C. power supply 108 having a voltage suitable for the production of corona at blade edge 106. Typical satisfactory voltages are in the range of 600 to 1000 volts, or higher. Generally, improved cleaning is noted at relatively higher voltages. Greater spacing between the blade edge and the photoreceptor will require higher voltages to maintain the cleaning function. The output frequency of the A.C. power supply 108 is selected to avoid a strobing cleaning effect that occurs at low frequencies which leaves periodic patterns of uncleaned toner on the photoreceptor. Typical operable output frequencies are in the range of 40–1800 Hz, or higher, with improved cleaning noted at relatively higher frequencies, and depending on photoreceptor speed. Minimum frequencies are based on the desired copying or process speed. Cleaning becomes more difficult at higher process speeds, requiring higher output frequencies and higher toner removal rates of the toner cleaned from the photoreceptor. It will be appreciated that at higher process speeds, to maintain good cleaning, higher voltages and/or higher frequency power supply output is required.

As toner on photoreceptor belt 10 approaches blade 102, it is exposed to the strong electric field produced thereat. The toner is agitated, released from the photoreceptor surface, and frequent and numerous toner/-toner impacts occur, increasing the amount of toner further released from the surface. With the toner released from photoreceptor belt 10, it forms a oscillating cloud generally adjacent blade 102. From this cloud, toner can be removed from the area for eventual transport to storage or return to the developer housing.

In one working embodiment of the invention, at a process speed of 4 inches per second on AMAT belt and selenium drum photoreceptors, an A.C. voltage of 900 volts at 1000 Hz was applied to a 5 mil thick steel blade. Toner was observed jumping from the photoreceptor surface in response to the electric field, about 1 mm in front of the blade. An oscillating toner cloud was formed, which was removed from the area adjacent the blade with an air stream. Toner should be continuously and rapidly removed from the cloud and the area adjacent to the blade, as the toner naturally tends to settle on the blade. Too much accumulation on the blade may cause corona shut down.

In accordance with FIG. 3, an arrangement is shown for removing toner from the toner cloud in the area adjacent to the blade 102 after release from photoreceptor belt 10. A blower 110 is arranged to produce a vacuum effect at blade 102. An air baffle plate 112 may be conveniently arranged adjacent and parallel to blade 102 to provide a channel 114 through which air and toner may be directed. Toner in a cloud configuration is easily carried by a moving airstream through the channel to a transport arrangement (not shown) for movement to storage or return to a developer housing. Other vacuum and airstream arrangements are possible and within the scope of the invention.

In accordance with FIG. 4, in another scheme for removal of toner from the area adjacent the A.C. biased blade, a biased roll 200 may be used with a D.C. supply 204 applying a bias for the collection of toner adjacent the area of toner clouding. The roll may be a simple metal roller. Toner collected on the roll is carried from the cleaning area to a chiseling removal blade 202, which removes toner from roll 200 to drop in a spiral auger 204. A seal 206 maintains toner at the auger area therewithin. Other arrangements which present a biased surface member for collection of toner from the cloud are also possible, such as for example, an auger or ribbon surface with a bias applied and an arrangement for removing collected toner therefrom. If the toner has magnetic properties, it may be possible to provide a series of magnetic poles on the rotating roller 250, as shown in FIG. 4A for the collection of magnetically attractable toner, instead of or in addition to biasing the roller.

In accordance with FIG. 5, in another embodiment for removal of toner from the area adjacent the A.C. biased blade, a surface provided with an electrostatic traveling wave conveyor may be provided, which through the phased biasing of electrodes 300 on surface 301 by A.C. power supply 302, collects toner from the cloud and carries it to a transport or storage area.

In accordance with yet another embodiment of the invention, as shown in FIG. 6, a ribbon-type cleaning blade 400 biased with an A.C. power supply 401 may be arranged in a continuous loop and driven with a driving arrangement (not shown) to bring a portion of its edge 404 into cleaning relationship, contacting or closely spaced, with the photoreceptor surface 10. Ribbon blade 400 may be moved along its path in a direction 404, for example, either intermittently or continuously, to bring a new cleaning edge into contact with the photoreceptor. There is a noted tendency of clouding toner to settle on the biased blade member. If the toner collects too thickly on the blade member, corona generation may be shut off. Accordingly, in its continuous path, blade 400 is moved past a simple cleaning blade arrangement 406 which wipes or doctors collecting toner from the blade into a sump or transport 408. Brushes and other arrangements to remove toner collecting on the ribbon cleaning blade may also be satisfactory.

In accordance with another embodiment of the invention, and with reference to FIG. 7, a thin wire electrode 500 riding on the photoreceptor surface 10 may be driven with a voltage below the corona threshold level, in approximately the range of 300 to 700 volts, and 3 KHz to 9 KHz, with optimum cleaning believed to occur at about 700 volts, and 9 KHz. The wire may be about 0.003" in diameter, and made from conductive wire materials such as for example tungsten, stainless steel etc. A pair of wires slightly spaced apart may also be useful. The wires may be mounted substantially within, or at the nozzle or aperture 501 of a vacuum device 502, defined by upstream and downstream walls 504, 506 which provide an airflow past the wire, where toner clouding is occurring, for the removal of toner. A seal 508 may be provided to enclose the cleaning area. The vacuum might be provided in accordance with the showings of FIG. 1. Of course, any of the methods used in the previous embodiments of FIGS. 2–6 might also be used for the removal of toner from the area adjacent to the wire, once the toner is in the cloud.

It will, of course, no doubt be appreciated that the A.C. biased cleaning member, which in use releases toner from the charge retentive surface against mechanical and electrostatic forces holding toner thereto, may be used in a wide number of applications. Thus, for example, the A.C. biased cleaning blade may be used in combination with or as a backup for other cleaning systems. The A.C. biased cleaning blade may be substituted for frictional cleaning blades in most applications with improved results.

While the present invention has been described with respect to the removal of toner from a surface in a cleaning function, it will also no doubt be appreciated that the inventive arrangement may also find use where a toner cloud producing arrangement is desirable. Thus, for example, a uniformly toned surface may be presented to the described cleaner arrangement as a means to generate a useful toner cloud as a source of toner for a latent image development process.

Further, because the blade may be supported in substantially non-disturbing contact with the charge retentive surface and can be rendered non-operational by reducing applied voltage to below corona producing levels, cleaning functions can be selectively controlled. Thus, if cleaning is not desired, power to the blade may be removed and cleaning will not occur. By providing a segmented blade, with each segment driven separately, areas across the photoreceptor may be selectably cleaned. This effect may provide many heretofore unappreciated functions.

The invention has been described with reference to a preferred embodiment. Obviously modifications will occur to others upon reading and understanding the specification taken together with the drawings. This embodiment is but one example, and various alternatives, modifications, variations or improvements may be made by those skilled in the art from this teaching which are intended to be encompassed by the following claims.

We claim:

1. In an electrostographic device having a charge retentive surface for development of latent images formed thereon with toner, a transfer station for transferring developed latent images to another surface, and means of cleaning residual toner remaining after transfer of the developed latent images from said charge retentive surface, said cleaning means comprising:

a conductive cleaning member;

said cleaning member supported adjacent to the charge retentive surface;

an A.C. power supply, electrically connected to said cleaning member, and driving said cleaning member to produce an electric field at said charge retentive surface, whereby residual toner, remaining after transfer of the developed latent images from said charge retentive surface, is released from said charge retentive surface into a cloud as it approaches said cleaning member, and means for removing said clouded toner from the area adjacent to said cleaning member.

2. The device as defined in claim 1 wherein said cleaning member is a conductive blade member driven to corona producing voltages.

3. The device as defined in claim 2 wherein said cleaning blade adjacent the charge retentive surface is supported in light contact therewith.

4. The device as defined in claim 2 wherein said A.C. power supply supplies a corona producing voltage to said cleaning blade of greater than 600 volts.

5. The device as defined in claim 4 wherein said A.C. power supply supplies a corona producing voltage to said cleaning blade of between 600 and 1000 volts.

6. The device as defined in claim 1 wherein said A.C. power supply supplies a frequency of greater than 40 Hz.

7. The device as defined in claim 6 wherein said A.C. power supply supplies a frequency of between 40 and 1800 Hz.

8. The device as defined in claim 1 wherein said cleaning member is a thin wire.

9. The device as defined in claim 8 wherein said thin wire adjacent the charge retentive surface is supported in light contact therewith.

10. The device as defined in claim 8 wherein said A.C. power supply supplies a non corona producing voltage to said cleaning member in the range of 300–700 volts.

11. The device as defined in claim 8 wherein said A.C. power supply supplies a frequency of greater than 3 KHz.

12. The device as defined in claim 8 wherein said A.C. power supply supplies a frequency of between 3 and 9 KHz.

13. In an electrostatographic device having a charge retentive surface for development of latent images formed thereon with toner, a transfer station for transferring developed latent images to another surface, and means of cleaning residual toner remaining after transfer of the developed latent images from said charge retentive surface, said cleaning means comprising:

a conductive cleaning blade;

said cleaning blade having an cleaning edge supported adjacent to the charge retentive surface;

an A.C. power supply, electrically connected to said cleaning blade, and driving said cleaning blade to a corona producing condition at said cleaning edge, whereby residual toner, remaining after transfer of the developed latent images from said charge retentive surface, is released from said charge retentive surface as it approaches said cleaning blade to form a toner cloud; and means for directing an airflow past said cleaning blade for the collection and transport of clouding toner to a sump.

14. A device as defined in claim 13 including a baffle plate arranged generally parallel and adjacent to said cleaning blade to define an airflow passage therebetween, and means for providing an airflow directed through said airflow passage and away from said cleaning edge.

15. In an electrostatographic device having a charge retentive surface for development of latent images formed thereon with toner, a transfer station for transferring developed latent images to another surface, and means of cleaning residual toner remaining after transfer of the developed latent images from said charge retentive surface, said cleaning means comprising:

a conductive cleaning blade;

said cleaning blade having an cleaning edge supported adjacent to the charge retentive surface;

an A.C. power supply, electrically connected to said cleaning blade, and driving said cleaning blade to a corona producing condition at said cleaning edge, whereby residual toner, remaining after transfer of the developed latent images from said charge retentive surface, is released from said charge retentive surface as it approaches said cleaning blade to form a toner cloud; and a biased toner collecting surface for collecting clouding toner from the area adjacent to said cleaning blade, said toner collecting surface movable to a toner releasing position where toner is removed from said toner collecting surface.

16. A device as defined in claim 15 wherein said biased surface is supported on a rotating member with a D.C. bias applied, said member rotating to a toner removal position, removed from the area adjacent to said cleaning blade where toner is removed with a detoning member to a transporting arrangement.

17. In an electrostatographic device utilizing a charge retentive surface for development of latent images formed thereon with toner, and an arrangement for transferring developed latent images to another surface, and means of cleaning residual toner remaining after transfer on said charge retentive surface, said cleaning means comprising:

a conductive cleaning blade;

said cleaning blade having a cleaning edge supported adjacent to the charge retentive surface;

an A.C. power supply, electrically connected to said cleaning blade, for driving said cleaning blade to a corona producing condition at said cleaning edge, whereby toner is released from said surface to form a toner cloud in the area adjacent to the cleaning blade; and a toner collecting surface including an electrostatic traveling wave arrangement for collecting clouding toner and moving said toner along said surface way from said area adjacent the cleaning blade.

18. In an electrostatographic device utilizing a charge retentive surface for development of latent images formed thereon with toner, and an arrangement for transferring developed latent images to another surface, a method of cleaning residual toner remaining after transfer on said charge retentive surface from the surface comprising the steps:

providing a conductive cleaning blade having a cleaning edge adjacent to the charge retentive surface;

driving said cleaning blade to a corona producing condition at said cleaning edge;

bringing at lease a portion of the charge retentive surface bearing residual toner remaining after transfer into close proximity to said cleaning edge, whereby toner is released from said surface to form a toner cloud in the area adjacent to the cleaning blade; and collecting toner from said cloud for removal from said area adjacent to the cleaning blade.

19. In an electrostatographic device having a charge retentive surface for development of latent images formed thereon with toner, a transfer station for transferring developed latent images to another surface, and means of cleaning residual toner remaining after transfer of the developed latent images from said charge retentive surface, said cleaning means comprising:

a conductive cleaning blade;

said cleaning blade having an cleaning edge, and formed into a continuous loop with a portion of said cleaning edge supported adjacent to the charge retentive surface in cleaning relationship therewith;

means for moving said cleaning blade along a path defined by said continuous loop to bring new portions of said cleaning edge into position adjacent to the charge retentive surface;

an A.C. power supply, electrically connected to said cleaning blade, and driving said cleaning blade to a corona producing condition at said cleaning edge, whereby residual toner, remaining after transfer of the developed latent images from said charge retentive surface, is released from said charge retentive surface as it approaches said cleaning blade, and collects on a surface of said blade; and means for removing said toner from said blade surface, at a location removed from said charge retentive surface.

20. In an electrostatographic device having a charge retentive surface for development of latent images formed thereon with magnetic toner, a transfer station for transferring developed latent images to another surface, and means of cleaning residual magnetic toner remaining after transfer of the developed latent images from said charge retentive surface, said cleaning means comprising:

a conductive cleaning blade;

said cleaning blade having an cleaning edge supported adjacent to the charge retentive surface;

an A.C. power supply, electrically connected to said cleaning blade, and driving said cleaning blade to a corona producing condition at said cleaning edge, whereby residual magnetic toner, remaining after transfer of the developed latent images from said charge retentive surface, is released from said charge retentive surface as it approaches said cleaning blade to form a toner cloud; and a toner collecting surface having a series of magnetically attractive areas thereon for collecting clouding magnetic toner from the area adjacent to said cleaning blade, said toner collecting surface movable to a toner releasing position where magnetic toner is removed from said toner collecting surface.

21. In an electrostatographic device having a charge retentive surface for development of latent images formed thereon with toner, a transfer station for transferring developed latent images to another surface, and means of cleaning residual toner remaining after transfer of the developed latent images from said charge retentive surface, said cleaning means comprising:

a conductive wire;

said cleaning member supported adjacent to the charge retentive surface;

an A.C. power supply, electrically connected to said cleaning member, and driving said cleaning blade to produce an electric field at said charge retentive surface, whereby residual toner, remaining after transfer of the developed latent images from said charge retentive surface, is released from said charge retentive surface into a cloud as it approaches said cleaning member, and means for removing said clouded toner from the area adjacent to said cleaning.

22. The device as defined in claim 21 wherein said cleaning member is a thin wire approximately 0.003″ in diameter.

23. The device as defined in claim 21 wherein said wire adjacent the charge retentive surface is supported in light contact therewith.

24. The device as defined in claim 21 wherein said A.C. power supply supplies a non-corona producing voltage to said cleaning member in the range of 300–700 volts.

25. The device as defined in claim 21 wherein said A.C. power supply supplies a non corona producing voltage in the range of 300–700 volts, and at a frequency of in the range of 5 KHz to 9 KHz.

26. The device as defined in claim 21 wherein said clouded toner removing means includes means for directing an airflow past said cleaning blade for the collection and transport of clouding toner to a sump.

27. The device as defined in claim 21 wherein said clouded toner removing means includes a biased toner collecting surface for collecting clouding toner from the area adjacent to said cleaning blade, said toner collecting surface movable to a toner releasing position where toner is removed from said toner collecting surface.

28. The device as defined in claim 21 wherein said clouded toner removing means includes a toner collecting surface having an electrostatic traveling wave arrangement for collecting clouding toner and moving said toner along said surface way from said area adjacent the cleaning blade.

29. The device as defined in claim 21 wherein said residual toner is magnetically attractable, and said clouded toner removing means includes a toner collecting surface having a series of magnetically attractive areas thereon for collecting clouding magnetic toner from the area adjacent to said cleaning blade, said toner collecting surface movable to a toner releasing position where magnetic toner is removed from said toner collecting surface.

* * * * *